US005803005A

United States Patent [19]

Stenning et al.

[11] Patent Number: 5,803,005

[45] Date of Patent: Sep. 8, 1998

[54] SHIP BASED SYSTEM FOR COMPRESSED NATURAL GAS TRANSPORT

[75] Inventors: David G. Stenning; James A. Cran, both of Calgary, Canada

[73] Assignee: Enron LNG Development Corp., Houston, Tex.

[21] Appl. No.: 885,292

[22] Filed: Jun. 30, 1997

Related U.S. Application Data

[63] Continuation of Ser. No. 787,807, Jan. 23, 1997, abandoned, which is a continuation of Ser. No. 550,080, Oct. 30, 1995, abandoned.

[51] Int. Cl.[6] ..... B63B 25/00

[52] U.S. Cl. ..... 114/72

[58] Field of Search ..... 114/72, 73, 74 T, 114/74 R, 74 A; 220/581, 901; 137/899.2

[56] References Cited

U.S. PATENT DOCUMENTS

| | | | |
|---|---|---|---|
| 2,411,235 | 11/1946 | Smith | 226/20.1 |
| 2,491,103 | 12/1949 | Noll et al. | 220/3 |
| 2,721,529 | 10/1955 | Jahnsen | 114/74 |
| 3,232,725 | 2/1966 | Secord et al. | 48/190 |
| 3,293,011 | 12/1966 | Lewis et al. | 48/190 |
| 3,830,180 | 8/1974 | Bolton | 114/74 A |
| 4,139,019 | 2/1979 | Bresie et al. | 137/351 |
| 4,213,476 | 7/1980 | Bresie et al. | 137/2 |
| 4,380,242 | 4/1983 | Bresie et al. | 137/113 |
| 4,446,804 | 5/1984 | Kristiansen et al. | 114/74 R |
| 4,715,721 | 12/1987 | Walker et al. | 114/72 |
| 4,846,088 | 7/1989 | Fanse et al. | 114/72 |
| 5,460,208 | 10/1995 | DeBerardinis | 114/72 |

FOREIGN PATENT DOCUMENTS

| | | | |
|---|---|---|---|
| 2194913 | 3/1974 | France . | |
| 1452058 | 9/1996 | France . | |
| 1233887 | 12/1963 | Germany . | |
| 830337 | 5/1981 | Russian Federation . | |
| 1133167 | 11/1968 | United Kingdom | 114/74 R |
| 2144840 | 3/1985 | United Kingdom . | |

OTHER PUBLICATIONS

Broeker, R.J. "A New Process for the Transportation of Natural Gas" Proceedings of the 1st International Conference on Liquified Natural Gas (7 Apr. 1968).

Hollyer, D.S. and Fowler, D.W."Economic Recovery of Marginal Offshore Gas" Proceedings of the 59th Annual Convention of the Gas Processors Association (17–19 Mar. 1980).

Pace Marine Engineering Sys. "Natural Gas Transport Ship" (undated).

Article Published in 1974 entitled CNG and MLG—New Natural Gas Transportation Processes by Robert J. Broeker, Director of Process Engineering of Columbia Gas System Service.

Article published in the early 1990's entitled Alternative ways to Develop an Offshore Dry Gas Field by R. H. Buchanan and A. V. Drew of Foster Wheeler Petroleum Development.

*Primary Examiner*—Stephen Avila

*Attorney, Agent, or Firm*—Vinson & Elkins, L.L.P.

[57] ABSTRACT

A ship based system for compressed natural gas transport that utilizes a ship having a plurality of gas cylinders. The invention is characterized by the plurality of gas cylinders configured into a plurality of compressed gas storage cells. Each compressed gas storage cell consists of between 3 and 30 gas cylinders connected by a cell manifold to a single control valve. A high pressure manifold is provided including means for connection to shore terminals. A low pressure manifold is provided including means for connection to shore terminals. A submanifold extends between each control valve to connect each storage cell to both the high pressure manifold and the low pressure manifold. Valves are provided for controlling the flow of gas through the high pressure manifold and the low pressure manifold.

26 Claims, 5 Drawing Sheets

SHIP BASED SYSTEM FOR COMPRESSED NATURAL GAS TRANSPORT

This application is a continuation of application Ser. No. 08/787,807, filed Jan. 23, 1997, which is a continuation of application Ser. No. 08/550,080, filed Oct. 30, 1995, both abandoned.

FIELD OF THE INVENTION

The present invention relates to natural gas transportation systems and, more specifically, to the transport of compressed natural gas over water by ship.

BACKGROUND OF THE INVENTION

There are four known methods of transporting natural gas across bodies of water. A first method is by way of subsea pipeline. A second method is by way of ship transport as liquified natural gas (LNG). A third method is by way of barge, or above deck on a ship, as compressed natural gas (CNG). A fourth method is by way of ship, inside the holds, as refrigerated CNG or as medium conditioned liquified gas (MLG). Each method has its inherent advantages and disadvantages.

Subsea pipeline technology is well known for water depths of less than 1000 feet. However, the cost of deep water subsea pipelines is very high and methods of repairing and maintaining deep water subsea pipelines are just being pioneered. Transport by subsea pipeline is often not a viable option when crossing bodies of water exceeding 1000 feet in depth. A further disadvantage of subsea pipelines is that, once laid, it is impractical to relocate them.

The liquefaction of natural gas greatly increases its density, thereby allowing a relatively few number of ships to transport large volumes of natural gas over long distances. However, an LNG system requires a large investment for liquefaction facilities at the shipping point and for regassification facilities at the delivery point. In many cases, the capital cost of constructing LNG facilities is too high to make LNG a viable option. In other instances, the political risk at the delivery and/or supply point may make expensive LNG facilities unacceptable. A further disadvantage of LNG is that even on short routes, where only one or two LNG ships are required, the transportation economics is still burdened by the high cost of full shore facilities.

In the early 1970's Columbia Gas System Service developed a ship transportation method for natural gas as refrigerated CNG and as pressurized MLG. These methods were described by Roger J. Broeker, their Director of Process Engineering, in an article published in 1974 entitled "CNG and MLG—New Natural Gas Transportation Processes". The CNG required the refrigeration of the gas to −75 degrees fahrenheit and pressurization to 1150 psi before placing into pressure vessels contained within an insulated cargo hold of a ship. No cargo refrigeration facilities were provided aboard ship. The gas was contained in a multiplicity of vertically mounted cylindrical pressure vessels. The MLG process required the liquefaction of the gas by cooling to −175 degrees fahrenheit and pressurization to 200 psi. One disadvantage of both of these systems is the required cooling of the gas to temperatures sufficiently below ambient temperature prior to loading on the ship. The refrigeration of the gas to these temperatures and the provision of steel alloy and aluminum cylinders with appropriate properties at these temperatures was expensive. Another disadvantage was dealing with the inevitable expansion of gas in a safe manner as the gas warmed during transport.

In 1989 U.S. Pat. No. 4,846,088 issued to Marine Gas Transport Ltd. which described a method of transporting CNG having the storage vessel disposed only on or above the deck of a seagoing barge. This patent reference disclosed a CNG storage system that comprised a plurality of pressure bottles made from pipeline type pipe stored horizontally above the deck of the seagoing barge. Due to the low cost of the pipe, the storage system had the advantage of low capital cost. Should gas leakage occur, it naturally vented to atmosphere to obviate the possibility of fire or explosion. The gas was transported at ambient temperature, avoiding the problems associated with refrigeration inherent in the Columbia Gas Service Corporation test vessel. One disadvantage of this method of transport of CNG described was the limit to the number of such pressure bottles that could be placed above deck and still maintain acceptable barge stability. This severely limits the amount of gas that a single barge can carry and results in a high cost per unit of gas carried. Another disadvantage is the venting of gas to atmosphere, which is now viewed as unacceptable from an environmental standpoint.

In a more recent years the viability of transport by barge of CNG has been studied by Foster Wheeler Petroleum Development. In an article published in the early 1990's by R. H. Buchanan and A. V. Drew entitled "Alternative Ways to Develop an Offshore Dry Gas Field", transport of CNG by ship was reviewed, as well as an LNG transport option. The proposal of Foster Wheeler Petroleum Development disclosed a CNG transport method comprised of a plurality of pipeline type pressure bottles oriented horizontally in a series of detachable multiple barge-tug combination shuttles. Each bottle had a control valve and the temperatures were ambient. One disadvantage of this system was the requirement for connecting and disconnecting the barges into the shuttles which takes time and reduces efficiency. A further disadvantage was the limited seaworthiness of the multi-barge shuttles. The need to avoid heavy seas would reduce the reliability of the system. A further disadvantage was the complicated mating system which would adversely affect reliability and increase cost.

Marine transportation of natural gas has two main components, the over water transportation system and the on shore facilities. The shortcoming of all of the above described CNG transport systems is that the over the water transportation component is too expensive for them to be employed. The shortcoming of LNG transport systems is the high cost of the shore facilities which, on short distance routes, becomes the overwhelming portion of the capital cost. None of the above described references addresses problems associated with loading and unloading of the gas at shore facilities.

SUMMARY OF THE INVENTION

What is required is an over water transportation system for natural gas which is capable of utilizing shore facilities which are much less expensive than LNG liquefaction and regassification facilities or CNG refrigeration facilities, and which also provides for over water transport of near ambient temperature CNG, that is less expensive that the prior art.

According to the present invention there is provided an improvement in over water CNG transport that utilizes a ship having a plurality of gas cylinders. The gas pressure in the cylinders would, preferably, be in the range of 2000 psi to 3500 psi when charged and in the range of 100 to 300 psi when discharged. The invention is characterized by the plurality of gas cylinders configured into a plurality of compressed gas storage cells. Each compressed gas storage cell consists of between 3 and 30 gas cylinders connected by a cell manifold to a single control valve. The gas cylinders will, preferably, be made from steel pipe with domed caps on each end. The steel cylinders may be wrapped with fibreglass, carbon fibre or some other high tensile strength fibre to afford a more cost effective bottle. A submanifold extends between each control valve to connect each storage cell to a high pressure main manifold and a low pressure main manifold. Both the high pressure main manifold and the low pressure main manifold include means for connection to shore terminals. Valves are provided for controlling the flow of gas through the high pressure manifold and the low pressure manifold.

With the ship based system for compressed natural gas transport, as described above, the on shore facilities mainly consist of efficient compressor stations. The use of both high and low pressure manifolds permits the compressors at the loading terminal to do useful work compressing pipeline gas up to full design pressure in some cells, while the cells are filling from the pipeline; and at the unloading terminal to do useful work compressing the gas of cells below pipeline pressure while some high pressure storage cells are simultaneously producing by blowdown. The technique of opening the storage cells in sequence by groups, one after another, so timed that the backpressure on the compressor is at all times close to the optimum pressure, minimizes the required compression horsepower.

Although beneficial results may be obtained through the use of the ship based system for compressed natural gas transport, as described above, even more beneficial results may be obtained by orienting the gas storage cells in a vertical manner. This vertical orientation will facilitate the replacement and maintenance of the storage cells should it be required.

Although beneficial results may be obtained through the use of the ship based system for compressed natural gas transport, as described above, the safe ocean transport of the CNG, once loaded, must also be addressed. Even more beneficial results may, therefore, be obtained when the hold of the ship is covered with air tight hatch covers. This permits the holds containing the gas storage cells to be flooded with an inert atmosphere at near ambient pressure, eliminating fire hazard in the hold.

Although beneficial results may be obtained through the use of the ship based system for compressed natural gas transport, as described above, adiabatic expansion of the CNG during the delivery process results in the steel bottles being cooled to some extent. It is desirable to preserve the coolness of this thermal mass of steel for its value in the next loading phase. Even more beneficial results may, therefore, be obtained when the hold and hatch covers are insulated.

Although beneficial results may be obtained through the use of the ship based system for compressed natural gas transport, as described above, should a gas leak occur it must be safely dealt with. Even more beneficial results may, therefore, be obtained when each hold is fitted with gas leak detection equipment and leaking bottle identification equipment so that leaking storage cells can be isolated and vented through the high pressure manifold system to a venting/flare boom. The natural gas contaminated hold would be flushed with inert gas.

Although beneficial results may be obtained through the use of the ship based system for compressed natural gas transport, as described above, in some markets a continuous supply of natural gas is crucial. Even more beneficial results may, therefore, be obtained when sufficient CNG ships of appropriate capacity and speed are used so that there is at all times a ship moored and unloading.

Although beneficial effects may be obtained through the use of the ship based system for compressed natural gas transport, as described above, there is a considerable pressure energy on the ship that could be used at the discharge terminal to produce refrigeration. Even more beneficial effects may, therefore, be obtained when an appropriate cryogenic unit at the unloading terminal is used to generate a small amount of LNG. This LNG, produced during a number of ship unloadings, will be accumulated in adjacent LNG storage tanks. This supply of LNG can be used in the event of an upset in CNG ship scheduling.

Although beneficial effects may be obtained through the use of the ship based system for compressed natural gas transport, as described above, some markets will pay a premium for peak-shaving fuel (ie. fuel delivered during the few hours per day of peak demand). Even more beneficial results may, therefore, be obtained if the main manifold system and unloading compressor station are so sized that the ship can be unloaded in the peak time, which is typically 4 to 8 hours.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
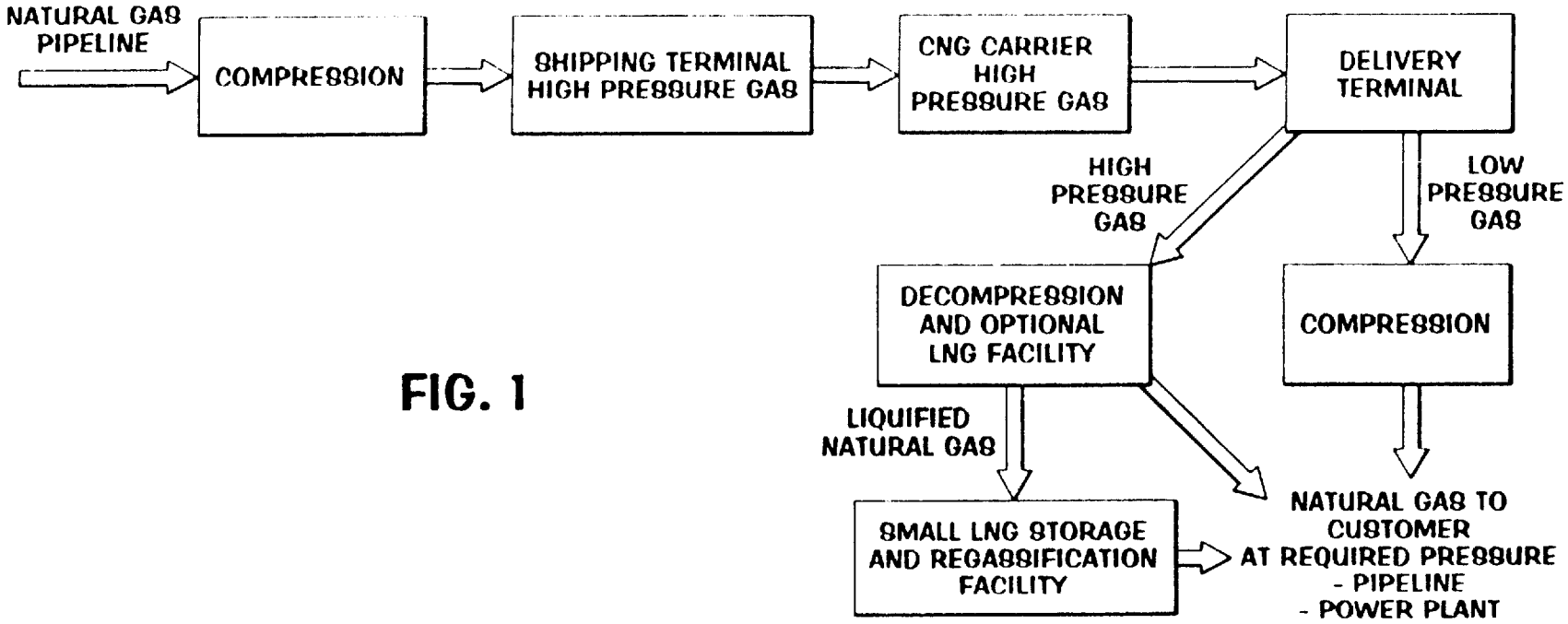
FIG. 1 is a flow chart setting forth the operation of a ship based system for compressed natural gas transport.

The preferred embodiment, a ship based system for compressed natural gas transport generally identified by reference numeral 10, will now be described with reference to FIGS. 1 through 4*b*.

Figure 2A:
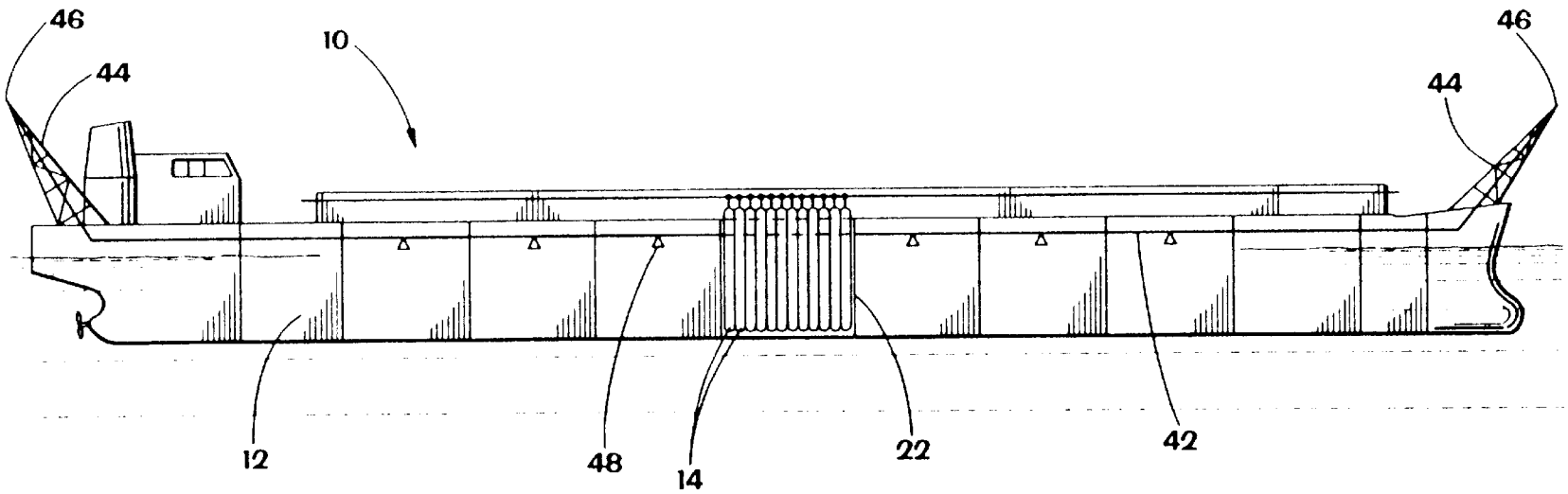
FIG. 2*a* is a side elevational view in section of a ship equipped in accordance with the teachings of the ship based system for compressed natural gas transport.
Figure 2B:
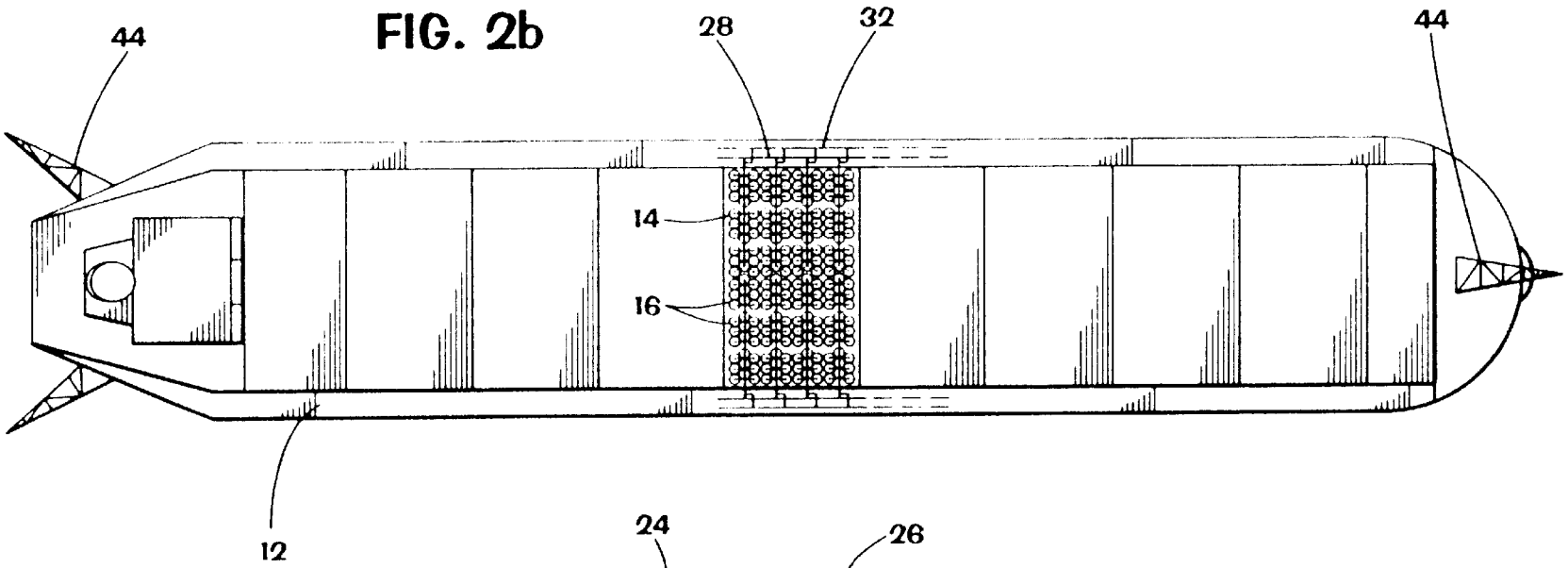
FIG. 2*b* is a top plan view in longitudinal section of the ship illustrated in FIG. 2*a*.

Referring to FIGS. 2*a* and 2*b*, ship based system for compressed natural gas transport 10 includes a ship 12 having a plurality of gas cylinders 14. The gas cylinders are designed to safely accept the pressure of CNG, which may range between 1000 to 5000 psi, to be set by optimization taking into account the cost of pressure vessels, ships, etc. and the physical properties of the gas. It is preferred that the values be in the range of 2500 to 3500 psi. Gas cylinders 14 are cylindrical steel pipes in 30 to 100 foot lengths. A preferred length is 70 feet long. The pipes will be capped, typically, by the welding of forged steel domes on both ends.

Figure 2C:
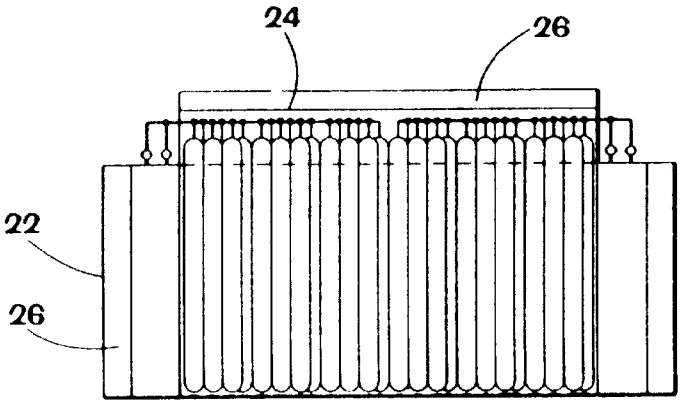
FIG. 2*c* is an end elevational view in transverse section taken along section lines A—A of FIG. 2*b*.
Figure 3:
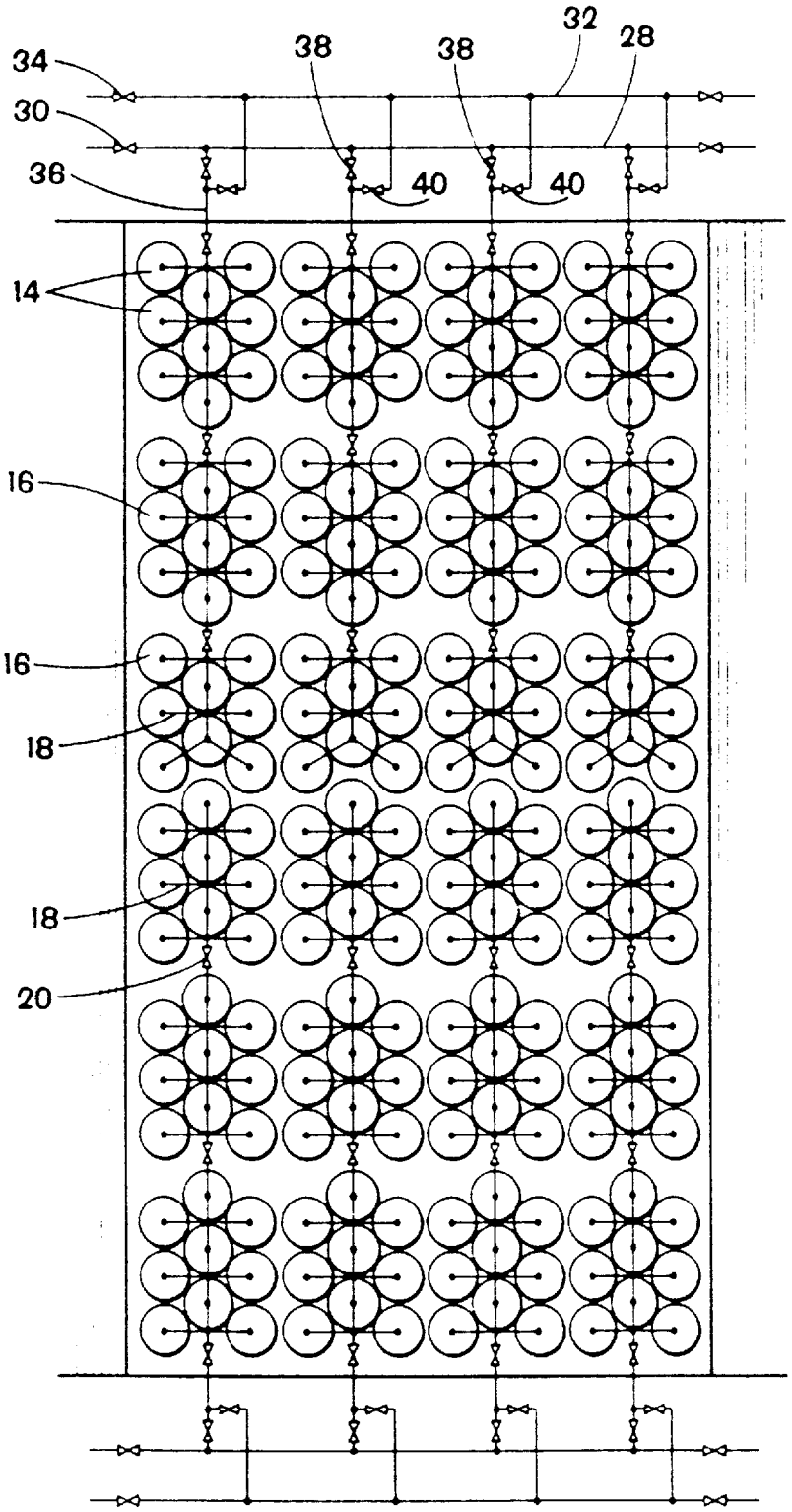
FIG. 3 is a detailed top plan view of a portion of the ship illustrated in FIG. 2*b*.
Figure 4A:
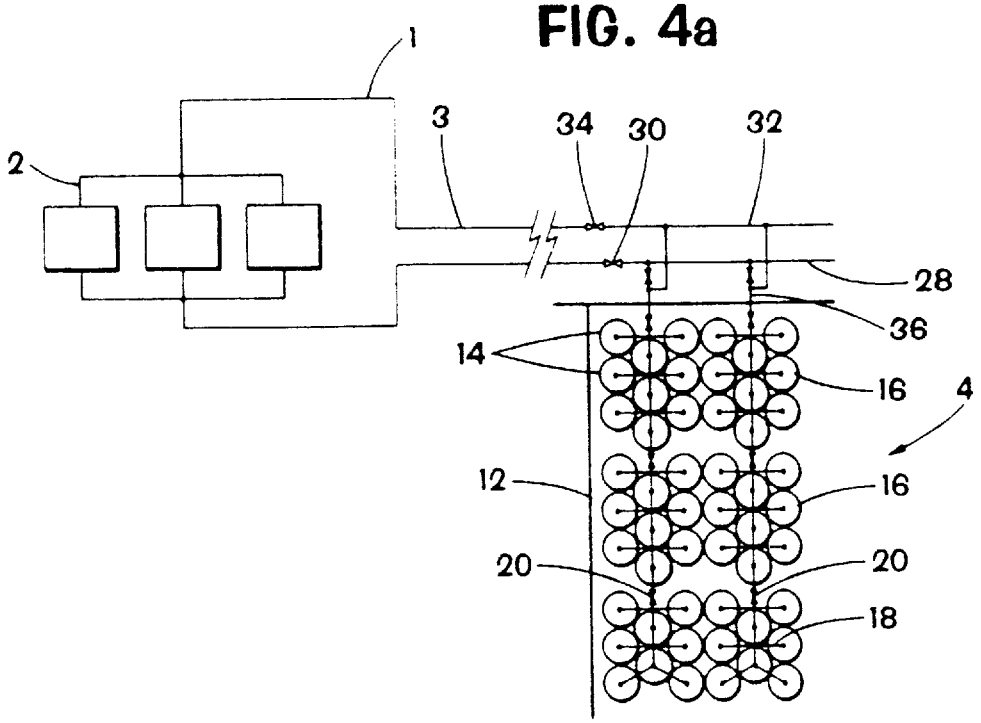
FIG. 4*a* is a schematic diagram of a loading arrangement for the ship based system for compressed natural gas transport.
Figure 4B:
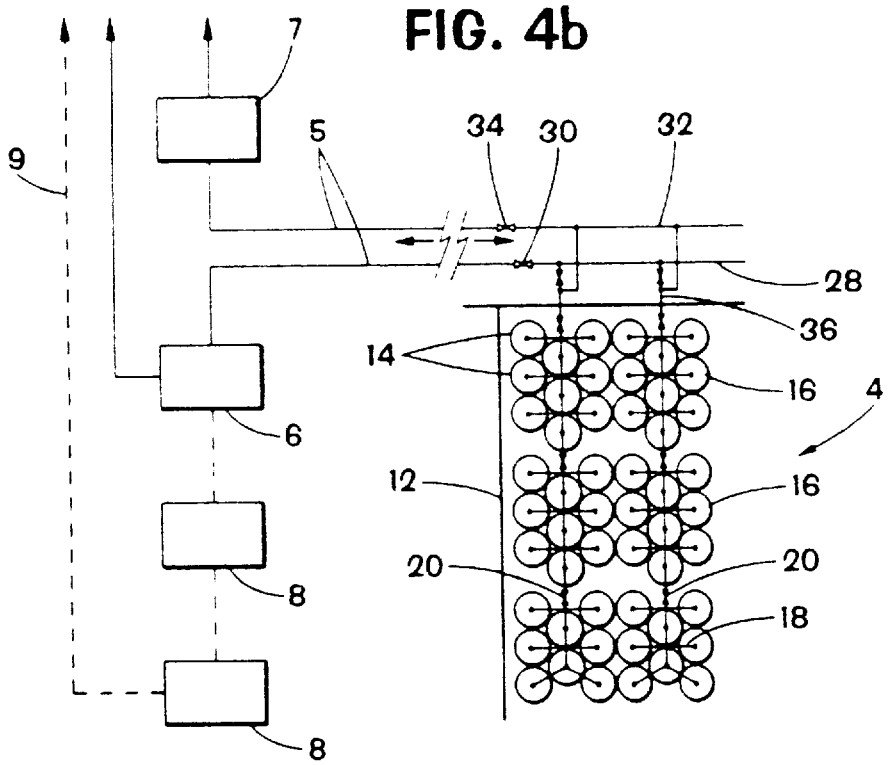
FIG. 4*b* is a schematic diagram of an unloading arrangement for the ship based system for compressed natural gas transport.

The plurality of gas cylinders 14 are configured into a plurality of compressed gas storage cells 16. Referring to FIG. 3, each of compressed gas storage cells 16 consist of between 3 and 30 gas cylinders 14 connected by a cell manifold 18 to a single control valve 20. Referring to FIGS. 2*a* and 2*c*, gas cylinders 14 are mounted vertically oriented, for ease of replacement, within a hold 22 of ship 12. The length of cylinders 14 will typically be set so as to preserve the stability of ship 12. The holds 22 are covered with hatch covers 24 to keep out seawater in heavy weather, but also to facilitate cylinder changeout. Hatch covers 24 will have airtight seals to enable holds 22 to be flooded with an inert atmosphere at near ambient pressure. The holds 22 are serviced by a low pressure manifold system 42, as shown in FIG. 2*a*, to provide initial flood and subsequent maintenance of the inert gas atmosphere.

The present invention contemplates little or no refrigeration of the gas during the loading phase. Typically the only cooling involved will be to return the gas to near ambient temperature by means of conventional air or seawater cooling immediately after compression. However, the lower the temperature of the gas, the larger the quantity that can be stored in the cylinders 14. Because of adiabatic expansion of the CNG during the delivery process, the steel cylinders 14 will be cooled to some extent. It is desirable to preserve the coolness of this thermal mass of steel for its value in the next loading phase, in typically 1 to 3 days time. For this reason, referring to FIG. 2*c*, both holds 22 and hatch covers 24 are covered with a layer of insulation 26.

Referring to FIG. 3, a high pressure manifold 28 is provided which includes a valve 30 adapted for connection to shore terminals. A low pressure manifold 32 is provided including a valve 34 adapted for connection to shore terminals. A submanifold 36 extends between each control valve 20 to connect each storage cell 16 to both high pressure manifold 28 and low pressure manifold 32. A plurality of valves 38 control the flow of gas from submanifold 36 into high pressure manifold 28. A plurality of valves 40 control the flow of gas from submanifold 36 into low pressure manifold 32. In the event that a storage cell must be rapidly blown down when the ship 12 is at sea, the gas will be carried by high pressure manifold 28 to a venting boom 44 and thence to a flare 46, as illustrated in FIG. 2*a*. If the engines of the ship 10 are designed to burn natural gas, either the high or low pressure manifold will convey it from the cells 16.

Ship 12, as described above, must be integrated as part of an overall transportation system with shore facilities. The overall operation of ship based system for compressed natural gas transport 10 will now be described with the aid of FIGS. 1, 4*a*, and 4*b*. FIG. 1 is a flow chart that sets forth the step by step handling of the natural gas. Referring to FIG. 1, natural gas is delivered to the system by a pipeline (1) at typically 500 to 700 psi. A portion of this gas can pass directly through the shipping terminal (3) to the low pressure manifold 32 to raise a small number of the cells 16 to the pipeline pressure from their "empty" pressure of about 200 psi. Those cells are then switched to the high pressure manifold 28 and another small number of empty cells are opened to the low pressure manifold 32. The larger portion of the pipeline gas is compressed to high pressure at the shipping point compression facility (2). Once the gas is compressed it is delivered via a marine terminal and manifold system (3) to the high pressure manifold 28 on the CNG Carrier (4) (which in this case is ship 12) whence it brings those cells 16 connected to it up to close to full design pressure (e.g. 2700 psi.) This process of opening and switching groups of cells, one after the other, is referred to as a "rolling fill". The beneficial effect is that the compressor (2) is compressing to its full design pressure almost all the time which makes for maximum efficiency. The CNG Carrier (4) carries the compressed gas to the delivery terminal (5). The high pressure gas is then discharged to a decompression facility (6) where the gas pressure is reduced to the pressure required by the receiving pipeline (9). Optionally the decompression energy of the high pressure gas can be used to power a cryogenic unit to generate a small portion of LPG, gas liquids, and LNG (6) which can be stored and the gas liquids and LNG regassified later (8) as required to maintain gas service to the market. At some point during the delivery of the gas, the gas pressure on the CNG Carrier will be insufficient to deliver gas at the rate and pressure required. At this time the gas will be sent to the delivery point compression facility (7) where it will be compressed to the pipeline (9) required pressure. If the above process is carried out with small groups of cells 16 at a time, a "rolling empty" results which will, as above, provide the compressor (7) with the design back pressure most of the time and hence use it with maximum efficiency.

Whether or not an LNG storage facility has been added, it is preferred that there shall be a sufficient number of CNG carrier ships 12 of appropriate capacity and speed so operated that there will be a ship moored and discharging at the delivery point at all times, except under upset conditions. Operated in this manner, the CNG ship system will provide essentially the same level of service as a natural gas pipeline. In an important alternative embodiment, the ship's manifolds and delivery compression station (7) can be so sized that the ship's cargo can be unloaded in a relatively short time, say 2–8 hours, typically 4 hours, versus one-half to three days, typically one day normal unloading time. This alternative would permit a marine CNG project to supply peak-shaving fuel into a market already possessed of sufficient base load capacity.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A ship based system for compressed natural gas transport including a ship having a plurality of gas cylinders, characterized by:

the plurality of gas cylinders being configured into a plurality of compressed gas storage cells, each compressed gas storage cells consisting of between 3 and 30 gas cylinders connected by a cell manifold to a single cell control valve;

a high pressure manifold including means for connection to shore terminals;

a low pressure manifold including means for connection to shore terminals;

a submanifold extending between each control valve to connect each storage cell to both the high pressure manifold and the low pressure manifold; and valves for controlling the flow of gas through the high pressure manifold and the low pressure manifold.

2. A system for compressed gas transport comprising:

a ship;

a plurality of compressed gas storage cells constructed and arranged to be transported by said ship, each of said compressed gas storage cells including a plurality of interconnected gas cylinders;

a high pressure manifold, said high pressure manifold including means adapted for connection to a shore terminal;

a low pressure manifold, said low pressure manifold including means adapted for connection to a shore terminal;

means for flow connecting each of said compressed gas storage cells to each of said high and low pressure manifolds; and valve means for selectively controlling the flow of compressed gas between each of said compressed gas storage cells and each of said high and low pressure manifolds, whereby each of said compressed gas storage cells selectively may be flow connected to each of said high and low pressure manifolds.

3. A system for compressed gas transport comprising:

a ship;

a plurality of compressed gas storage cells constructed and arranged to be transported by said ship, each of said compressed gas storage cells including a plurality of gas cylinders interconnected by a cell manifold to a single cell control valve;

a high pressure manifold, said high pressure manifold including means adapted for connection to a shore terminal;

a low pressure manifold, said low pressure manifold including means adapted for connection to a shore terminal;

a plurality of submanifolds, each of said submanifolds extending between and connecting said high pressure manifold and said low pressure manifold to a plurality of said single cell control valves; and means for selectively controlling the flow of compressed gas between each of said submanifolds and each of said high and low pressure manifolds, whereby each of said compressed gas storage cells selectively may be flow connected to each of said high and low pressure manifolds.

4. The system for compressed gas transport according to claim 1, 2 or 3, wherein said ship has cargo holds and said plurality of gas cylinders are vertically oriented within said cargo holds.

5. The system for compressed gas transport according to claim 4, comprising additionally:

a substantially airtight hatch cover for each of said cargo holds; and means for supplying an inert gas to each of said cargo holds;

whereby, each of said cargo holds can be flooded with an inert atmosphere of said inert gas.

6. The system for compressed gas transport according to claim 5 wherein said cargo holds and said substantially airtight hatch covers are thermally insulated.

7. The system according to claim 4, comprising additionally:

gas leak detection equipment in each of said cargo holds; and means for venting compressed gas from a leaking gas storage cell to atmosphere.

8. The system according to claim 1, 2 or 3 additionally including:

a shore terminal for receiving compressed gas from said ship, and wherein a plurality of said ships are used to provide a substantially continuous supply of compressed gas to said shore terminal.

9. The system according to claim 1, 2 or 3 additionally including:

a shore terminal for receiving compressed gas from said ship, and wherein said shore terminal includes a cryogenic unit for converting a portion of said compressed gas received from said ship into liquefied gas.

10. The system according to claim 1, 2 or 3 additionally including:

a shore terminal for receiving compressed gas discharged from said high pressure manifold and from said low pressure manifold of said ship and for supplying said compressed gas to a gas transmission pipeline, said shore terminal including unloading compressor means for compressing said gas received from said low pressure manifold prior to supplying said gas from said low pressure manifold to said pipeline.

11. The system according to claim 10 wherein said high pressure and low pressure manifolds and said unloading compressor means are sized and constructed to permit substantially complete unloading of said ship within about 8 hours.

12. The system according to claim 7 wherein said means for venting compressed gas to atmosphere includes a flare.

13. The system according to claim 1, 2 or 3 wherein each of said plurality of gas cylinders can contain compressed gas at from about 1,000 psi to about 5,000 psi.

14. The system according to claim 2 or 3 wherein each of said compressed gas storage cells includes not less than 3 nor more than 30 of said gas cylinders.

15. A ship based system for compressed natural gas transport including a ship having a plurality of gas cylinders, characterized by:

the plurality of gas cylinders being configured into a plurality of compressed gas storage cells, each compressed gas storage cells consisting of between 3 and 30 gas cylinders connected by a cell manifold to a single control valve, the gas cylinders being vertically oriented within holds of the ship, each hold of the ship being covered with air tight hatch covers thereby enabling each hold of the ship to be flooded with an inert atmosphere at near ambient pressure, each hold and hatch cover being insulated;

a high pressure manifold including means for connection to shore terminals;

a low pressure manifold including means for connection to shore terminals;

a submanifold extending between each control valve to connect each storage cell to both the high pressure manifold and the low pressure manifold;

valves for controlling the flow of gas through the high pressure manifold and the low pressure manifold;

each hold having a low pressure manifold to provide initial flood and subsequent maintenance of the inert gas atmosphere; and each hold being fitted with gas leak detectors so that leaking storage cells can be isolated and vented through the high pressure manifold system to a venting/flare boom.

16. A system for compressed gas transport, said system comprising:

a ship having a plurality of cargo holds;

a plurality of vertically oriented gas cylinders disposed in each of said cargo holds, said plurality of gas cylinders in each of said cargo holds being configured into one or more compressed gas storage cells, each of said compressed gas storage cell including from about 3 to about 30 of said gas cylinders;

each of said plurality of gas cylinders within each of said compressed gas storage cells being connected by a cell manifold to a single cell control valve;

each of said cargo holds having at least one substantially airtight hatch cover, whereby each of said cargo holds can be flooded with an inert atmosphere at near ambient pressure;

each of said cargo holds and said airtight hatch covers being thermally insulated;

a high pressure manifold, said high pressure manifold including means adapted for connection to a shore based terminal;

a low pressure manifold, said low pressure manifold including means adapted for connection to a shore based terminal;

submanifold means for connecting each said single cell control valve to both said high pressure manifold and said low pressure manifold;

valve means for selectively controlling the flow of compressed gas between said submanifold means and each of said high pressure manifold and said low pressure manifold;

an inert gas manifold for supplying inert gas to each of said cargo holds for supply and maintenance of said inert atmosphere in each of said cargo holds; and a gas leak detector in each of said cargo holds, whereby leaking compressed gas storage cells can be detected and vented to a venting/flare boom.

17. In combination:

a. an on-shore compressor station; and b. a ship based system for compressed natural gas transport including a ship having a plurality of gas cylinders, characterized by:

the plurality of gas cylinders being configured into a plurality of compressed gas storage cells, each compressed gas storage cells consisting of between 3 and 30 gas cylinders connected by a cell manifold to a single control valve;

a high pressure manifold including means for connection to said on-shore compressor station;

a low pressure manifold including means for connection to said on-shore compressor station; and a submanifold extending between each control valve to connect each storage cell to both the high pressure manifold and the low pressure manifold; and valves for controlling the flow of gas through the high pressure manifold and the low pressure manifold.

18. In combination:

(a) a shore based facility including compressor means; and (b) a ship based system for compressed gas transport, said ship based system including:

a plurality of ship transportable compressed gas storage cells, each of said compressed gas storage cells including a plurality of gas cylinders connected by a cell manifold to a cell control valve;

a high pressure manifold including means adapted for connection to said shore based facility;

a low pressure manifold including means adapted for connection to said shore based facility;

a submanifold extending between and connecting a plurality of said cell control valves to both said high pressure and said low pressure manifolds, to thereby connect a plurality of said compressed gas storage cells to both said high pressure manifold and said low pressure manifold;

valve means for controlling the flow of compressed gas between said submanifold and each of said high pressure manifold and said low pressure manifold.

19. A method for filling a ship-borne storage system with compressed gas from a shore facility adapted to supply compressed gas from a supply pipeline to said ship at a first pressure corresponding substantially to supply pipeline pressure and at a second pressure which is greater than supply pipeline pressure, said ship-borne storage system including a low pressure manifold adapted to receive gas at said first pressure from said shore based facility, a high pressure manifold adapted to receive gas at said second pressure from said shore based facility and a plurality of gas storage cells each of said gas storage cells including a plurality of interconnected gas cylinders, said method comprising the steps of:

(a) connecting a first gas storage cell to said low pressure manifold;

(b) conducting a portion of said compressed gas at said first pressure through said low pressure manifold to partially fill said first gas storage cell to substantially said first pressure;

(c) isolating said first gas storage cell from said low pressure manifold;

(d) connecting said first gas storage cell to said high pressure manifold;

(e) conducting a portion of said compressed gas at said second pressure through said high pressure manifold to said first gas storage cell to fill said first gas storage cell to substantially said second pressure;

(f) connecting a second gas storage cell to said low pressure manifold; and (g) continuing said steps until substantially all of said gas storage cells are filled with compressed gas at substantially said second pressure.

20. A method for discharging compressed gas from a ship-borne storage system to a shore facility adapted to supply such gas at pipeline pressure to a gas pipeline, said shore facility including decompression means for decompressing gas received from said ship prior to supplying the same to said pipeline and compressor means for compressing gas received from said ship prior to supplying same to said pipeline, said ship-borne storage system including a high pressure manifold adapted to discharge gas to said decompression means and a low pressure manifold adapted to discharge gas to said compressor means and a plurality of gas storage cells each of said gas storage cell including a plurality of interconnected gas cylinders containing compressed gas at a ship borne pressure which is substantially greater than said pipeline pressure, said method comprising the steps of:

(a) connecting a first gas storage cell to said high pressure manifold;

(b) discharging a portion of said compressed gas from said first gas storage cell through said high pressure manifold to said decompression means;

(c) isolating said first gas storage cell from said high pressure manifold;

(d) connecting said first gas storage cell to said low pressure manifold;

(e) conducting a portion of said compressed gas from said first gas storage cell through said low pressure manifold to said compressor means;

(f) connecting a second gas storage cell to said high pressure manifold; and (g) continuing said steps until substantially all of said gas storage cells have discharged a portion of their compressed gas through each of said high pressure and low pressure manifolds.

21. The method according to claim 20 wherein said compressed gas is allowed to expand adiabatically during said ship discharging process.

22. The method according to claim 21 wherein said adiabatic expansion of said compressed gas is used to chill said plurality of gas cylinders; and additionally including the step of maintaining the chill of said gas cylinders until said chilled gas cylinders are refilled with compressed gas.

23. The method according to claim 20 wherein said shore facility also includes additional compressor means for converting a portion of said gas into liquefied gas and storage means for storing said liquefied gas and additionally including the step of directing a portion of said compressed gas discharged from said high pressure manifold to power said additional compressor means.

24. The method according to claim 23 wherein said compressed gas is natural gas and said liquefied gas is LNG.

25. The system according to claim 1, 2, 3, 15, 16, 17, 18, 19 or 20 wherein said gas cylinders are constructed from welded steel pipe with domed welded caps on each end.

26. The system according to claim 2, 3, 16, 18, 19 or 20 wherein said gas is natural gas.

* * * * *